US005261941A

United States Patent [19]

Sheinberg

[11] Patent Number: 5,261,941

[45] Date of Patent: Nov. 16, 1993

[54] HIGH STRENGTH AND DENSITY TUNGSTEN-URANIUM ALLOYS

[75] Inventor: Haskell Sheinberg, Los Alamos, N. Mex.

[73] Assignee: The United States of America as represented by the United States Department of Energy, Washington, D.C.

[21] Appl. No.: 796,872

[22] Filed: Nov. 25, 1991

Related U.S. Application Data

[63] Continuation of Ser. No. 681,295, Apr. 8, 1991, abandoned.

[51] Int. Cl.[5] ..... C22C 28/00

[52] U.S. Cl. ..... 75/248; 75/228; 420/3; 420/430; 428/568; 102/501; 102/517

[58] Field of Search ..... 75/228, 248; 420/3, 420/430; 428/568; 102/501, 517

[56] References Cited

U.S. PATENT DOCUMENTS

| | | | |
|---|---|---|---|
| 2,581,253 | 1/1952 | Ellis et al. | 266/1 |
| 3,823,002 | 7/1974 | Kirby, Jr. et al. | 29/182.1 |
| 3,929,476 | 12/1975 | Kirby, Jr. et al. | 75/214 |
| 4,314,399 | 2/1982 | Severinsson | 29/420 |
| 4,327,156 | 4/1982 | Dillon et al. | 428/568 |
| 4,554,218 | 11/1985 | Gardner et al. | 428/567 |
| 4,560,621 | 12/1985 | Landingham | 428/566 |
| 4,710,223 | 12/1987 | Matejczyk | 75/248 |
| 4,959,194 | 9/1990 | Dunn et al. | 420/3 X |
| 4,966,750 | 10/1990 | LaSalle et al. | 102/501 X |
| 4,970,960 | 11/1990 | Feldmann | 75/248 X |

OTHER PUBLICATIONS

C. H. Schramm et al., "The Alloy Systems Uranium-Tungsten, Uranium-Tantalum and Tungsten-Tantalum," J. of Metals, Trans. AIME, vol. 188, pp. 195-204 (Jan. 1950).

Max Hansen, *Constitution of Binary Alloys.* 2nd Ed (McGraw-Hill Book Company, Inc., New York, Toronto, London, 1958), pp. 1248-1249.

O. S. Ivanov et al., "Phase Diagrams of Uranium Alloys," Academy of Sciences of the USSR, A. A. Baikov Institute of Metallurgy, TT 76-52046, Nauka Publishers, Moscow, pp. 612-613, (1972).

*Primary Examiner*—Donald P. Walsh
*Assistant Examiner*—Daniel Jenkins
*Attorney, Agent, or Firm*—Richard J. Cordovano; Paul D. Gaetjens; William R. Moser

[57] ABSTRACT

Alloys of tungsten and uranium and a method for making the alloys. The amount of tungsten present in the alloys is from about 55 vol % to about 85 vol %. A porous preform is made by sintering consolidated tungsten powder. The preform is impregnated with molten uranium such that (1) uranium fills the pores of the preform to form uranium in a tungsten matrix or (2) uranium dissolves portions of the preform to form a continuous uranium phase containing tungsten particles.

1 Claim, No Drawings

HIGH STRENGTH AND DENSITY TUNGSTEN-URANIUM ALLOYS

This is a continuation of application Ser. No. 07/681,295 filed Apr. 8, 1991 now abandoned.

BACKGROUND OF THE INVENTION

This invention relates to the art of powder metallurgy. This invention is the result of a contract with the Department of Energy (Contract No. W-7405-ENG-36).

Alloys of tungsten in uranium are conventionally produced by coreducing uranium tetrafluoride with tungsten oxide or tungsten fluoride. The maximum amount of tungsten which can be alloyed with uranium to obtain a coherent shape using this coreducing process is about 4 wt %. In U.S. Pat. No. 4,959,194, issued Sept. 25, 1990, entitled "High Strength Uranium-Tungsten Alloy Process" (Dunn et al.), a method of making alloys of tungsten and uranium is disclosed. These alloys may be described as dispersion-strengthened and precipitation-strengthened alloys where tungsten particles are uniformly dispersed throughout the alloy. The composition of these alloys ranges from about 4 wt % to about 35 wt % tungsten. In an article in the Journal of Metals (January 1950) entitled "The Alloy Systems Uranium-Tungsten, Uranium-Tantalum and Tungsten-Tantalum," Schramm, Gordon, and Kauffman reported on their work which resulted in construction of a phase diagram for the uranium tungsten system.

SUMMARY OF THE INVENTION

This invention is alloys of tungsten and uranium and a method for making the alloys. The amount of tungsten present in the alloys is from about 55 vol % to about 85 vol %. The mechanical properties of these alloys are a significant improvement over those of the alloys in the above mentioned patent. A porous preform is made by sintering consolidated tungsten powder. The preform is impregnated with molten uranium such that uranium fills the pores of the preform. Alternatively, the molten uranium will dissolve bonds between tungsten particles so that there is a continuous phase of uranium containing tungsten particles. To accomplish this, the preform is placed in a mold having dimensions larger than the preform and the molten uranium is poured into the mold. After cooling, the body is removed from the mold and the exterior skin of pure uranium is removed to obtain a body comprised of uranium and tungsten.

It is an object of this invention to provide high strength alloys containing uranium and to provide a process for making such alloys.

It is also an object of this invention to provide a high density alloy having an atomic cross-section close to that of uranium but having strength and stiffness greater than uranium.

In a broad embodiment, this invention is a method for making an alloy consisting of (1) a porous matrix formed of tungsten particles and uranium located in the pores of the matrix or (2) tungsten particles in a continuous uranium phase, where the amount of tungsten present in the alloy is from about 55 vol % to about 85 vol %, said method comprising consolidating tungsten powder by vibration or pressing; sintering said consolidated tungsten powder in a hydrogen atmosphere to form a coherent shape; placing said shape in a mold larger than said shape; subjecting said shape to a pressure of less than atmospheric pressure for a sufficient time period to effect degassing of said shape; heating said shape to a temperature of at least 950° C.; pouring molten uranium into said mold; allowing said mold and its contents to cool and removing the cast body from the mold; and removing uranium from the surfaces of said cast body to make the dimensions of said body approximately equal to the dimensions of said sintered shape.

DETAILED DESCRIPTION OF THE INVENTION

Tungsten-uranium alloys of this invention were prepared in the following manner. Commercially pure tungsten powder having nominal particle sizes of 4.5, 7.5, and 10 microns was obtained from General Electric. Powder of 19 microns was obtained from Kennametal of Latrobe, Pa. The four sizes of tungsten particles were not mixed; each alloy of the present invention was made using only one size of tungsten particles. The inventive alloys which were tested were made using 19 micron powder. It was determined that the 19 micron powder contained iron and nickel impurities. The uranium used to make the alloys was depleted uranium, which is substantially nonradioactive and is 99.98 wt % $U^{238}$ with the balance being $U^{235}$. Tungsten powder was consolidated by subjecting it to vibration in a ceramic container or by isostatically pressing at room temperature. Pressing pressure was 50,000 psi (345 MPa); it is expected that pressures ranging from about 15,000 psi (103.5 MPa) to well above 50,000 psi may be used.

The consolidated powder was sintered to form a coherent shape, or porous preform, at about 1800° C. for about 2 hours. The sintered porous preforms had densities in the range of 50 to 80% of theoretical density. Sintering temperature may range from about 1250° to about 1850° C. and sintering may take from about one hour to about 4 hours. Sintering was done in a furnace in a hydrogen atmosphere in order to remove tungsten oxide which may have formed on the tungsten particles and to prevent further formation of tungsten oxide. The coherent shapes which were made were cylinders of 0.5 inches in diameter and 9 inches long. Sintering caused the tungsten particles to bond together to form a shape having open pores.

The preform was placed in a slight depression in the center of a cylindrical crucible having an inside diameter and a height greater than the outside dimensions of the preform. The crucible was graphite with a coating of stabilized zirconia to prevent reaction between the metals and the graphite. The porous preform was subjected to vacuum in order to remove gas in the pores of the preform in order to facilitate infiltration of the preform by molten uranium. The pressure was reduced to a value in a range of about 10 to 100 microns for at least 1½ hours. The degassing period could be as long as 12 hours or as short as one-half hour. Uranium was melted in a similar crucible and brought to a temperature about 200° C. above its melting point. The melting point of uranium is about 1132° C. and that of tungsten is about 3410° C. An optical pyrometer was used to determine temperatures. The molten uranium was poured into the crucible containing the preform without moving the preform. The preform must be at a temperature of at least 950° C. degrees in order to prevent premature freezing of the uranium as it infiltrates the preform; in the experimentation, the preform was heated to 1000° C. The uranium must remain molten until it reaches the center of the preform. The temperature of the uranium added to the mold may range from about 150° to 300° C. above the melting point of uranium. The pressure of the atmosphere in which uranium is added to the mold may be increased to as high as 35 psi, in order to enhance infiltration into the preform.

After cooling, the cast body was removed from the mold and pure uranium was removed from it by machining to bring its dimensions to those of the preform, thus yielding a body consisting of tungsten and uranium.

Samples of the inventive alloys were subjected to mechanical testing in both tension and compression. Test results are presented in the Table. Data for pure uranium and pure tungsten are shown for purposes of comparison. Data for 80 vol % uranium/20 vol % tungsten which was made according to the process of the patent mentioned above is also presented; note the significant improvement in mechanical properties in the alloys of the present invention. Inventive alloys having 55, 70, and 72 vol % tungsten were tested. One of the samples was worked before testing and showed an increase in strength due to the working. The strengths of the 55 vol % tungsten alloy were surprisingly low; the reason for the low values is not known.

The size of the tungsten powder particles is determined by a Fisher sub-sieve sizer. It is expected that powder varying in size from the minimum readily obtainable (about 0.5 micron) to about 100 microns may be used in the present invention. Coherent shape refers to an object and is used to distinguish an object from a powder. Though only alloys having up to 77 vol % tungsten were prepared, I believe that this process may be used to make alloys having up to about 85 vol % tungsten.

The microstructures of the alloys can be varied by varying the sintering time and temperature to obtain two different forms. As the sintering time and temperature is increased, the size of the bonds between adjacent particles of tungsten, which are called the necks, increases. When molten uranium is added to the preform, it tends to preferentially dissolve the necks, since they are areas of high energy. If the necks are small, enough dissolution can take place such that the microstructure is particles of tungsten in uranium. With longer sintering time, the necks are not fully dissolved and the alloy is a tungsten matrix containing uranium. There are applications for both forms of microstructure: where uranium with a high loading of tungsten particles is desirable and also where a tungsten matrix containing uranium is wanted.

In both types of structures, when the relatively impure 19 micron nominal size tungsten powder was used in preparing the alloys, many fine tungsten particles were observed in the uranium phase. These particles were predominantly in the 3 to 6 micron size range with some in the 5 to 20 nm size range. When commercially pure 7.5 micron tungsten powder was used to prepare the alloys, fewer of the small tungsten particles were observed in the uranium phase.

TABLE

| Material | Density $Mg/m^3$ | Yield Strength, psi $\times 10^3$ (MPa) | Modulus of Elasticity psi $\times 10^6$ (MPa $\times 10^{-3}$) |
|---|---|---|---|
| | | Tensile Properties | |
| W | — | 78 (537) | 58 (400) |
| [2]W | — | 95 (655) | — |
| U | 19.0 | 26 (179.2) | 21.1 (145.5) |
| [1]U - 20% W | 19.06 | 101 (697) | 27.4 (188.9) |
| *U - 70% W | 19.21 | 142.5 (982) | 41.8 (288.2) |
| | | Compressive Properties | |
| U | 19.0 | 47 (324) | 24 (165) |
| [1]U - 20% W | 19.06 | 90 (620) | 28.3 (195) |
| *U - 72% W | 19.22 | 190 (1309) | 43.4 (299) |
| *[2]U - 72% W | 19.22 | 220 (1517) | 43.4 (299) |
| *U - 55% W | 19.16 | 83.2 (573) | 28.0 (193) |

*Denotes the inventive alloys.
[1]Denotes alloys made per U.S. Pat. No. 4,959,194.
[2]This sample was worked before testing.

What is claimed is:

1. An alloy consisting of a porous matrix formed of tungsten having uranium located in the pores of the matrix or consisting of tungsten particles in a continuous uranium phase, where the amount of tungsten present in the alloy is from about 55 vol % to about 85 vol % and where said uranium contains dissolved tungsten.

* * * * *